US005505221A

United States Patent [19]

Gao

[11] Patent Number: 5,505,221

[45] Date of Patent: Apr. 9, 1996

[54] UMBRELLA WITH OFF-CENTER SUPPORT

[76] Inventor: Hua Gao, 8400 N. Port Washington Rd., Fox Point, Wis. 53217

[21] Appl. No.: 399,064

[22] Filed: Mar. 8, 1995

[51] Int. Cl.[6] ..... A45B 11/00

[52] U.S. Cl. ..... 135/20.1; 135/25.31

[58] Field of Search ..... 135/20.1, 15.1, 135/21, 25.3, 25.31, 25.32

[56] References Cited

U.S. PATENT DOCUMENTS

| | | | |
|---|---|---|---|
| 2,948,289 | 8/1960 | Owczarek | 135/20.1 |
| 3,042,055 | 7/1962 | Todorovic | 135/20.1 |
| 3,818,919 | 6/1974 | Schultes et al. | 135/25.3 |
| 4,474,201 | 10/1984 | Kida | 135/20.1 |
| 4,542,758 | 9/1985 | Okuda | 135/25.3 |
| 4,597,400 | 7/1986 | Trudeau, Sr. | 135/20.1 X |
| 5,235,997 | 8/1993 | Good | 135/25.3 |
| 5,307,827 | 5/1994 | Haddad et al. | 135/20.1 |

FOREIGN PATENT DOCUMENTS

| | | | |
|---|---|---|---|
| 2598895 | 11/1987 | France | 135/20.1 |

*Primary Examiner*—Lanna Mai
*Attorney, Agent, or Firm*—Ryan, Maki & Hohenfeldt

[57] ABSTRACT

An umbrella with an off-center support shaft an umbrella canopy has an elongated shape, which is symmetrical along a central plane. Support ribs of two separate types are provided to simultaneously raise and lower the asymmetric ends of the canopy. Shorter, preferably telescoping ribs secure the shorter end of the canopy to the top of the shaft. Longer ribs connect the wider side of the canopy and terminating at an upper end at a point along the canopy spaced from the shaft. Deployment arms are pivotally connected to the ribs at a point spaced from their upper ends. The ribs are connected to the top of the shaft by first and second hinged connecting arms, one of the arms being also pivotally connected to the deployment arm, which at its opposite end is connected pivotally to a sleeve slidably mounted on the shaft. The deployment members, the connecting arms and the longer ribs form a parallelogram shaped hinge joint for extending the longer ribs outwardly when the canopy is erected.

3 Claims, 3 Drawing Sheets

UMBRELLA WITH OFF-CENTER SUPPORT

FIELD OF THE INVENTION

This invention relates to umbrellas that have an off-center shaft.

BACKGROUND OF THE INVENTION

The umbrella is a very common personal accessory, but the shaft of a standard umbrella is located at the center of the umbrella with the frame being symmetric. The head and body of the user have to thus be on the side of the shaft, and a big umbrella canopy will be needed to cover the whole body of the user.

Due to the fact that the shaft is in the center of the umbrella, if the shaft could be offset from the center of the umbrella, the head and body of the user could be located at the center of the umbrella thereby improving the performance of the umbrella. In other words the off-center umbrella is more efficient than a regular umbrella, even though they both are the same size. Thus an off-center umbrella of a smaller size will be just as effective as a larger standard umbrella.

SUMMARY OF THE INVENTION

This invention provides a novel off-center umbrella. The shaft of the off-center umbrella is deviated from the center of the umbrella and is located at approximately ⅓ of the distance across the diameter of the umbrella. The advantage of the off-center umbrella is that the head and body of user can be positioned at the center of the umbrella when the umbrella is open. It is thus an important object of the invention to provide an umbrella that is more efficient and thus smaller than an equally effective standard umbrella.

In accordance with an important aspect of the invention, the frame of an off-center umbrella is asymmetric, thus displacing the shaft from the center of the umbrella. In a preferred embodiment of the invention there are eight ribs which are of different length and a different angle is formed between the ribs. From the shortest support rib to longest support rib, the length of each support rib is gradually increased and the angle between every two support ribs is gradually decreased.

Two different types of support ribs, longer and shorter, are used in this invention in order to have the frame open and collapse coordinately. The shorter support ribs are each directly connected to at one of their ends to the top of the support shaft of the umbrella. The shorter support ribs, which are constructed so that they can telescope in length, thus open and collapse pivotally on the connecting joint located at the top of the shaft. The longer support ribs, however, are not directly connected to this joint on the top of the shaft. Instead a quadrilateral hinge mechanism on each of the longer ribs provides a joint by which longer support ribs and shorter telescoping support ribs can be opened and collapsed coordinately thus providing an off-center umbrella which can fold or unfold just as easily as a standard umbrella.

Briefly, the invention provides an umbrella with an off-center support shaft an umbrella canopy has an elongated shape, which is symmetrical along a central plane. Support ribs of two separate types are provided to simultaneously raise and lower the asymmetric ends of the canopy. Shorter, preferably telescoping ribs secure the shorter end of the canopy to the top of the shaft. Longer ribs connect the wider side of the canopy and terminating at an upper end at a point along the canopy spaced from the shaft. Deployment arms are pivotally connected to the ribs at a point spaced from their upper ends. The ribs are connected to the top of the shaft by first and second hinged connecting arms, one of the arms being also pivotally connected to the deployment arm, which at its opposite end is connected pivotally to a sleeve slidably mounted on the shaft. The deployment members, the connecting arms and the longer ribs form a parallelogram shaped hinge joint for extending the longer ribs outwardly when the canopy is erected.

DETAILED DESCRIPTION OF THE INVENTION

FIGS. 1–6 show an off-center umbrella 10 which consists of a frame 20 and a umbrella canopy 18.

Figure 1:
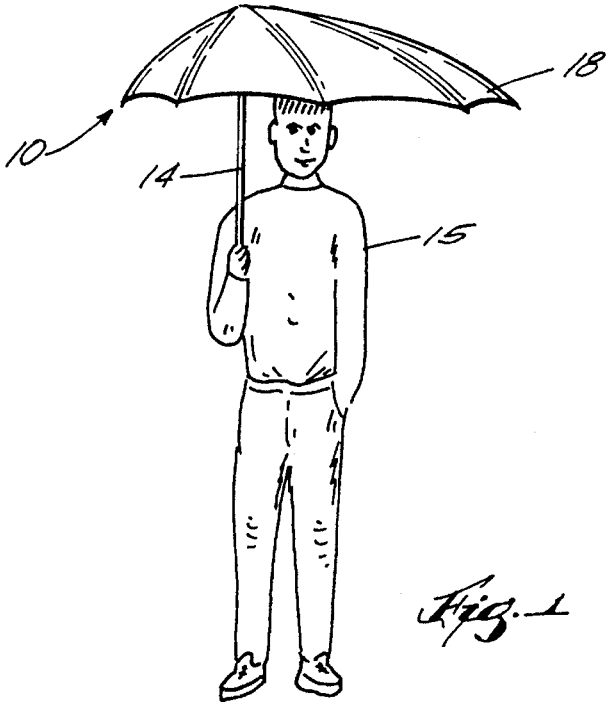
FIG. 1 is a frontal elevational view of an off-center umbrella.

FIG. 1 shows generally the off-center umbrella 10 manually held by user 15 in which the shaft 14 is displaced from the center of the umbrella so that the off-center umbrella 10 is asymmetric. Canopy 18 is supported by a plurality of ribs 22, 24, 26, 28, 30, 32, 34 and 36, some of which are shorter and some of which are longer, in order to accommodate the elongated shape of the canopy 18. Referring the FIG. 3, if a line is drawn between the end of long support rib 30 to the end of short support rib 22, a line is provided that defines the maximum diameter of the umbrella. The shaft 14 is preferably located on this line approximately at ⅓ of the distance from one end, in this case, the end of rib 22. As seen in FIG. 1, when the off-center umbrella 10 is used, the head and body of user can be placed under the middle of the off-center umbrella 10.

Figure 2:
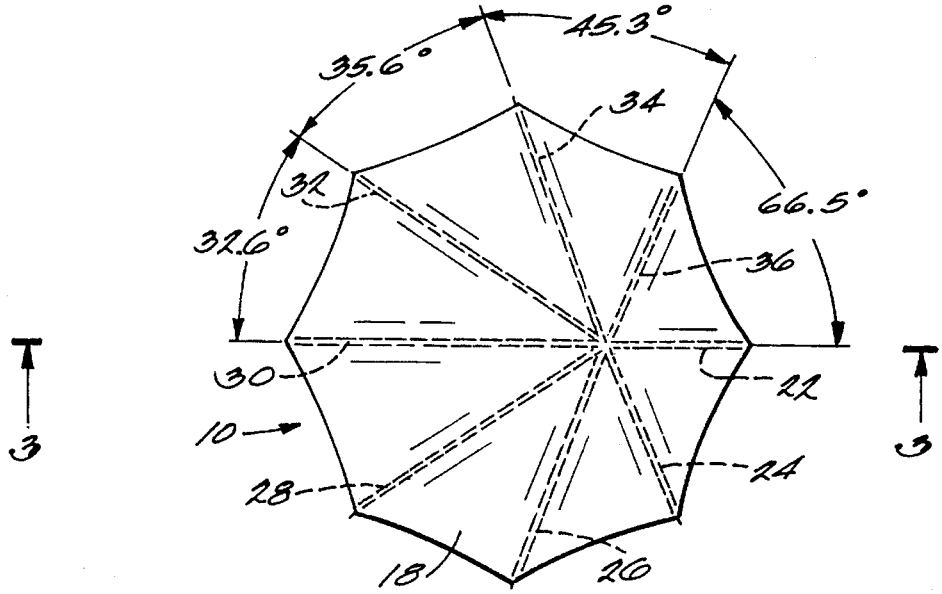
FIG. 2 is a top view of the umbrella of FIG. 1.

Referring to the FIG. 2, a umbrella canopy 18 preferably has eight triangular components and frame 20 is provided with 8 support ribs of varying length. The length of each support rib is gradually increased from the short support rib 22 to long support rib 30, but the angle between successive support ribs is gradually decreased.

Figure 3:
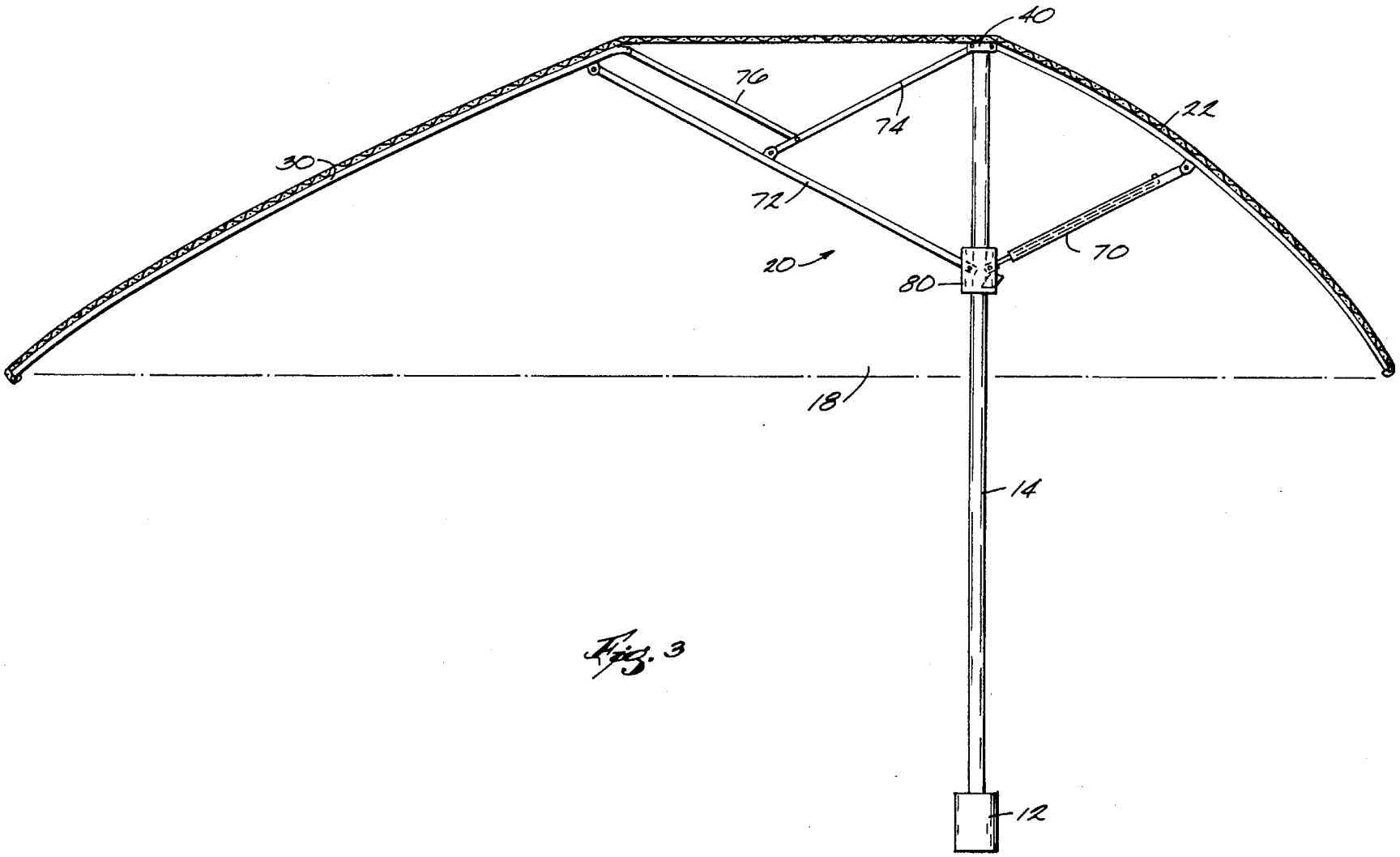
FIG. 3 sectional view taken along Line 3—3 of FIG. 2.

FIG. 3 illustrates the difference between short support ribs 22, 24 and 36 and long support ribs 26, 28,30, 32 and 34. The frame 20, in addition to the support ribs consists of a handle 12, a shaft 14, which may be of conventional two-part telescoping construction, and a movable sleeve 80 slidably mounted on shaft 14. Each rib is connected pivotally to a deployment arm 70 or 72, which arms are each, in turn, pivotally connected at their opposite ends to sleeve 80. The upper end of each of the shorter support ribs (22, 24 or 36) is pivotally connected to an end cap 40 at the upper end of shaft 14. The distal end of a deployment arm 70 connects pivotally to the middle of the short support rib 22, and the proximal or lower end of the deployment arm 70 connects to movable sleeve 80. Each short support rib (22, 24 or 36) is opened and collapsed by a deployment arm 70 as the movable sleeve 80 is moved up and down.

Figure 5:
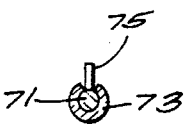
FIG. 5 is a sectional view taken along Line 5—5 of FIG. 4.
Figure 6:
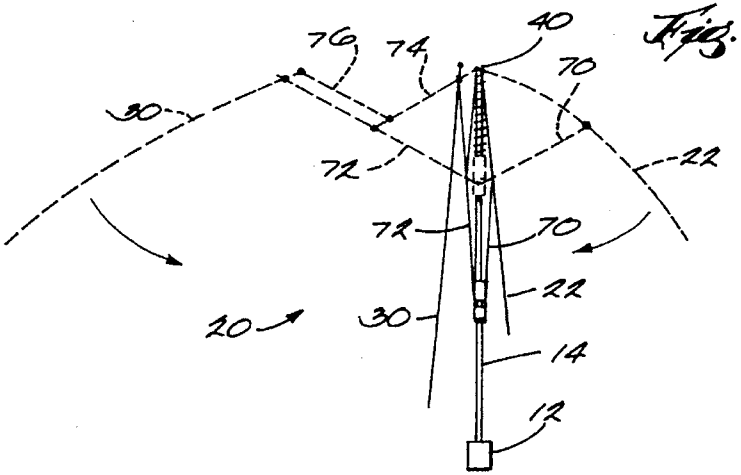
FIG. 6 is a schematic drawing of the frame of the umbrella in the collapsed position.
Figure 4:
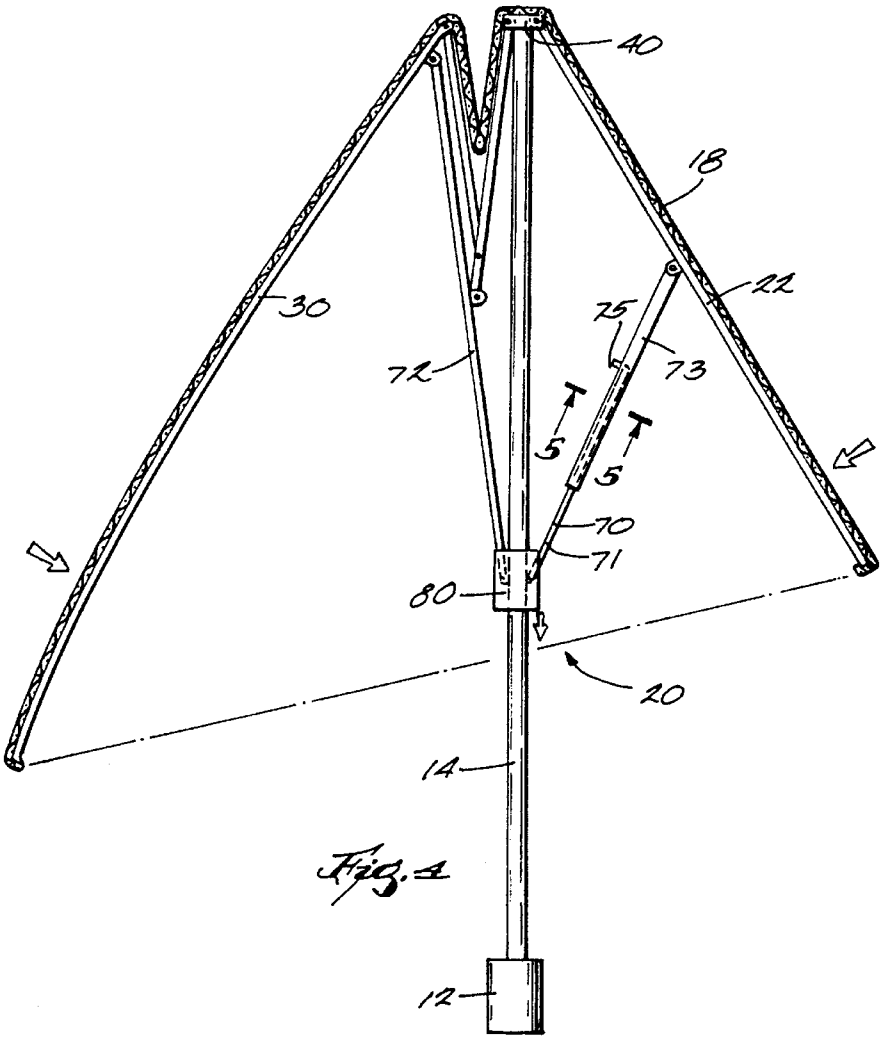
FIG. 4 is a sectional view of the structure shown in FIG. 3 in the partially collapsed position.

As seen in FIGS. 3, 4 and 5, deployment arm 70 is formed of two parts, 71 and 73, which are telescopingly fitted together. Deployment arm 70 is thus reduced in length as the umbrella is erected and allowed to lengthen as the umbrella 10 is collapsed, thus enabling complete collapse of the umbrella.

The long support ribs (26–34) connect indirectly to cap 40 on the top of the shaft 14 through a quadrilateral or four bar joint assembly formed by the upper ends of rib 30, deployment arm 72, a first connecting arm 74 and a second connecting arm 76. Each first connecting arm 74 is pivotally connected between end cap 40 and the central part of deployment arm 72. Each second connecting arm 76 pivotally connects the upper end of a rib such as rib 30, which is shown for illustrative purposes, to first arm 74. The four sides of the quadrilateral joints thus formed serve to rapidly pivot rib 30 outwardly when sleeve 80 is raised. As the frame is opened, there is no support rib from the end of rib 30 to end cap 40, but umbrella canopy 18 is pulled sufficiently taut to maintain extension by itself.

The frame 20 is thus opened or collapsed by the deployment arms 70, 72. As the movable sleeve 80 on the shaft 16 moves up and down, the deployment arms 70–72 and the support ribs 22, 30 can be moved coordinately as the movable sleeve 80 moves up and down.

What is claimed is:

1. An umbrella with an off-center support shaft comprising an umbrella canopy having an elongated shape, said elongated shape being symmetrical along a central plane, a support shaft located to one side of the center of said canopy along said plane;

a plurality of support ribs forming a supporting framework for said canopy, each of said ribs being attached at a lower end to an edge of said canopy, said ribs being provided in first and second types;

said first type comprising shorter ribs securing the shorter end of said canopy to such shaft, said shorter ribs each being secured at an upper end to the top of said shaft and at a lower end to the edge of said canopy;

said second type comprising longer ribs connected at a lower end to the edge of said canopy and terminating at an upper end at a point along said canopy spaced from said shaft and being pivotally connected at a point spaced from said upper end to a deployment arm, said deployment arms each being connected pivotally to a sleeve slidably mounted on said shaft said slidable collar being mounted on said shaft and being slidable from an unlocked position near the bottom of such shaft for allowing said umbrella canopy to collapse and being lockable at a raised position along said shaft to erect said canopy;

a plurality of pivoting deployment members each pivotally connected to said collar at their inner ends and pivotally connected, respectively to one of said first or second ribs at their opposite ends;

said deployment members being pivotally connected to said longer ribs at a point displaced from the inner ends thereof; each of said deployment members having a central pivot point to which a pivoting connecting member is attached, said pivoting connecting members each being connected pivotally at their upper ends to the upper end of said shaft, said deployment members and said longer ribs forming a parallelogram shaped hinge joint for extending said longer ribs outwardly when said canopy is erected.

2. An umbrella according to claim 1 wherein said shorter ribs are formed of two parts which are telescopingly attached to each other where by said members are able to elongate when said umbrella is collapsed.

3. An umbrella with an off-center support shaft comprising an umbrella canopy having an elongated shape which is symmetrical along a central plane, and asymmetric ends having outer perimeters located at differing distances from said support shaft, thereby forming a shorter end and an longer end of said canopy, support ribs of two separate types being provided to simultaneously raise and lower the asymmetric ends of the canopy including shorter, preferably telescoping ribs securing the shorter end of the canopy to the top of the shaft, longer ribs connected to the wider side of the canopy and terminating at an upper end at a point along the canopy spaced from the shaft, deployment arms pivotally connected to the longer ribs at a point spaced from their upper ends, the ribs being connected to the top of the shaft by first and second hinged connecting arms, one of said arms being also pivotally connected to the deployment arm, which at its opposite end is connected pivotally to a sleeve slidably mounted on the shaft, at least one of said deployment members, parts of its associated first and second connecting arms and part of its associated longer rib forming a parallelogram shaped hinge joint for extending the longer rib outwardly when the canopy is erected.

* * * * *